US011684158B2

(12) United States Patent
Wolle et al.

(10) Patent No.: US 11,684,158 B2
(45) Date of Patent: Jun. 27, 2023

(54) SHELF SYSTEM FOR SERVICE VEHICLES IN PARTICULAR AND ASSOCIATED CONTAINER

(71) Applicant: **TANOS GmbH Verpacken *Ordnen* Präsentieren**, Illertissen (DE)

(72) Inventors: Lutz Wolle, Burlafingen (DE); Markus Barabeisch, Vöhringen (DE)

(73) Assignee: **TANOS GmbH Verpacken *Ordnen* Präsentieren**, Illertissen (DE)

( * ) Notice: Subject to any disclaimer, the term of this patent is extended or adjusted under 35 U.S.C. 154(b) by 164 days.

(21) Appl. No.: 16/954,455

(22) PCT Filed: Jan. 8, 2019

(86) PCT No.: PCT/EP2019/050270
§ 371 (c)(1),
(2) Date: Jun. 16, 2020

(87) PCT Pub. No.: WO2019/137878
PCT Pub. Date: Jul. 18, 2019

(65) Prior Publication Data

US 2021/0076820 A1 Mar. 18, 2021

(30) Foreign Application Priority Data

Jan. 15, 2018 (DE) ..... 10 2018 100 724.8

(51) Int. Cl.
*A47B 88/00* (2017.01)
*F25D 25/02* (2006.01)
(Continued)

(52) U.S. Cl.
CPC ..... *A47B 88/57* (2017.01); *A47B 88/402* (2017.01); *A47B 88/417* (2017.01); *A47B 88/477* (2017.01); *A47B 2210/098* (2013.01)

(58) Field of Classification Search
CPC ..... A47B 88/57; A47B 88/477; A47B 88/402; A47B 88/417; A47B 2210/098; F25D 25/025
See application file for complete search history.

(56) References Cited

U.S. PATENT DOCUMENTS

2006/0032827 A1 2/2006 Phoy
2013/0313956 A1 11/2013 Renfro

FOREIGN PATENT DOCUMENTS

AT 392725 B * 3/1949
DE 68912808 T2 5/1994
(Continued)

OTHER PUBLICATIONS

German Examination Report issued for priority application 10 2018100724.8, dated Dec. 14, 2018; 8 pages.
(Continued)

*Primary Examiner* — Kimberley S Wright
(74) *Attorney, Agent, or Firm* — George McGuire

(57) ABSTRACT

The invention relates to a shelf system for service vehicles having at least one container which has a front side, a rear side, a bottom, a top and two side walls, and at least one guide element along which the container can be moved in the pull-out direction from a rear, retracted position into a front, extended position, with at least one rear stop and at least one front stop being provided on the container and interacting with a dead stop provided on at least one guide element in such a way that the container remains in a defined rear position and, when moved in the pull-out direction, in a defined front position, and a recess being provided in at least one side wall of the container for engaging a guide strip provided on the guide element, wherein the at least one front stop and the at least one rear stop are arranged below the relevant recess.

21 Claims, 2 Drawing Sheets

(51) Int. Cl.

| | |
|---|---|
| ***A47B 88/57*** | (2017.01) |
| ***A47B 88/477*** | (2017.01) |
| ***A47B 88/40*** | (2017.01) |
| ***A47B 88/417*** | (2017.01) |

(56) References Cited

FOREIGN PATENT DOCUMENTS

| | | | | | |
|---|---|---|---|---|---|
| DE | 102004005362 | | | 8/2005 | |
| DE | 102017128562 | A1 | * | 6/2019 | ..... A47B 88/57 |
| EP | 2179678 | A1 | * | 4/2010 | ..... A47B 88/12 |
| EP | 2359715 | | | 8/2011 | |
| EP | 3491970 | B1 | | 6/2020 | |
| GB | 620113 | A | * | 3/1949 | |
| JP | S63502322 | A | | 9/1988 | |
| JP | 3057590 | U | | 6/1999 | |
| JP | 200265380 | A | | 3/2004 | |
| JP | 2006341682 | A | | 12/2006 | |
| WO | 2008156384 | | | 12/2008 | |

OTHER PUBLICATIONS

Office Action from European Patent Office, dated Aug. 3, 2022. pp. 1-5.
Translated Japanese Office Action, dated Feb. 25, 2022. pp. 1-6.

* cited by examiner

SHELF SYSTEM FOR SERVICE VEHICLES IN PARTICULAR AND ASSOCIATED CONTAINER

CROSS-REFERENCE TO RELATED APPLICATION

The present application is the United States National Phase application of PCT Application PCT/EP2019/050270, filed Jan. 8, 2019, which relates and claims priority to German Application No. DE 10 2018 100 724.8 filed Jan. 15, 2018, the entirety of each of which is incorporated herein by reference.

BACKGROUND

The invention relates to a shelf system for service vehicles in particular, comprising at least one container which has a front side, a rear side, a bottom, a top and two side walls, and comprising at least one guide element along which the container can be moved in the pull-out direction from a rear, retracted position into a front, extended position. At least one rear stop and at least one front stop are provided on the container, the stops interacting with a dead stop provided on at least one guide element in such a way that the container remains in a defined rear position and, when moved in the pull-out direction, in a defined front position. In at least one side wall of the container there is a recess for engaging a guide strip provided on the guide element. The invention also relates to a container for such a shelf system.

Boxes, cases, crates, receptacles or other means for holding objects can be used as containers.

Such shelf systems having associated containers are known for example from DE 10 2004 005 362 A1. By providing front stops and rear stops, the container can thus remain in particular in two positions, namely in the secured rear position and in the defined front position. The container, which is arranged in a shelf system in a vehicle, can thus be prevented from automatically moving into the front position or even falling out of the shelf system from the front position when the vehicle corners, for example. The containers can be used in particular for storing tools or machines. The containers should be able to be inserted into the vehicle or removed from the vehicle, including tools or machines, in a simple manner.

In the known shelf system, the front and rear stops are provided on the side walls within the recesses in which the guide strips provided on the guide element engage. There is a distance between the bottom of the stops and a slide rail provided on the base of the container, which distance is greater than the height of a dead stop provided there on the guide element in the form of a locking lug. As a result, the locking lug can be guided inside the recess between the locking stop and the slide rail. Furthermore, according to this prior art, the container, when moving, slides on a base to which the guide elements are fastened.

Other shelf systems, which, however, are not suitable for being attached in service vehicles, are known for example from EP 00 572 971 A2 or JP 9-10048.

The problem addressed by the present invention is that of providing a shelf system that remedies the disadvantages of the prior art and in which in particular a base on which the container slides when moving is not required.

SUMMARY OF THE INVENTION

This problem is solved by a shelf system having the at least one front stop and the at least one rear stop are arranged below the relevant recess. This achieves a spatial separation of the at least one recess provided in the side wall of the container from the stops. The containers can preferably also be removed from the shelf system or removed from the at least one guide element by lifting in the front position.

The stops are therefore not in the recess, as in the prior art according to DE 10 2004 005 362 A1, but are arranged so as to be freely accessible therebelow, preferably on the bottom of the container. The stops preferably extend downward so that they can interact with the dead stop in a suitable manner. The recess provided in the relevant side wall is preferably open to the rear, i.e. opposite the pull-out direction, so that the guide strip interacting with the relevant recess can be introduced into the relevant recess when the container is inserted.

Two guide elements are preferably provided to the side of the container. The guide elements are advantageously fixed in place, such that the container can be moved along the guide elements, preferably so as to slide thereon. To move the container from the defined rear position into the front position, it is necessary to lift the container at the front side such that the front stop is raised above the dead stop. In the front position, the rear stop strikes against the dead stop, causing the container to remain in the defined front position. In order to remove the container from the shelf system in a further step, the rear stop can then be lifted such that it is no longer in engagement with the dead stop. The rear stop can be lifted by suitably pivoting the container about an axis transverse to its direction of movement, in particular by lifting the container again at the front side.

In order to enable a safe and defined movement of the container, it is advantageous if at least the rear stop has a sliding surface on its bottom which slides on a guide rail of the guide element when the container is moved. The material pairing of the sliding surface and the guide rail can be such that the coefficient of friction is correspondingly low. If two guide rails and two rear stops are provided on the bottom of the container in the region of its side walls, the weight of the container is consequently conveyed via the rear stops into the guide elements and thus into the shelf system.

With regard to the guide element, it is advantageous if the guide rail is arranged below the guide strip. The guide strip engages in the side recess. The sliding surface of the rear stop lies on the guide rail.

It is also advantageous if the guide element has a cheek on which the guide rail and the guide strip are arranged. The cheek can in particular be arranged so as to extend vertically, in which case the guide rail and the guide strip extend in the horizontal direction. The cheek can in particular be arranged on a frame or on a wall by means of suitable fastening means.

In order to make it easier to insert the container into the guide rails, it is advantageous if the guide strip is arranged so as to be offset to the rear with respect to the guide rail. As a result, when the container is inserted into the shelf system the rear side of the container can be placed on the guide rail and then moved backward such that the guide strip engages in the recess in the container.

It is also advantageous if the recess, which is in particular open to the rear, is delimited at the bottom by a strip portion on the relevant side wall of the container. The strip portion preferably extends in the pull-out direction and, when the container is inserted, preferably extends in parallel with the pull-out direction or with the guide strip or with the guide rail.

It is also advantageous if in particular the rear stop is arranged on the strip portion so as to project downward. This results in an inexpensive and compact design.

In order to avoid damage to the stops and/or the strip portions when the container is placed or laid on, it is advantageous if the bottom of the relevant strip portion is arranged so as to be set back upward from a base plane lying in the bottom of the container. As a result, the strip portion is reliably protected, for example when the container is placed on asphalt or other rough surfaces.

In this context, it is also advantageous if the sliding surface, in particular of the relevant rear stop, and/or if the bottom of the relevant front stop lies in the base plane or does not project beyond it. As a result, the stops can be protected, in particular when the container is on a rough surface.

In order to enable the container to be favorably moved from the rear position into the front position, it is advantageous if the guide strip is spaced apart and/or offset to the rear from the top of the strip portion to such an extent that the front side of the container in the defined rear position can be lifted to such an extent that the front stop can be raised above the dead stop. The container can then be pulled forward in a simple manner until the rear stop acts against the dead stop and the pulled-out position is reached.

In order to remove the container from the shelf system, it is advantageous if the guide strip is spaced apart and/or set back to the rear from the top of the strip portion to such an extent that the front side of the container in the defined front position can be lifted to such an extent that the rear stop can be raised above the dead stop. In this position, the container can then be pulled forward until it can finally be removed from the guide elements.

It is further advantageous if a stop portion is provided on at least one, and preferably on both side walls, in the region facing the rear side for abutting, in a supporting manner, the bottom of the guide strip of the guide element. By interaction of the container-side abutment portion with the bottom of the guide strip on the guide element side, the front side of the container can be prevented from tipping when the container is pulled out. The arrangement is preferably such that even in the front, pulled-out position of the container, the abutment portion acts against the bottom of the guide strip such that a counterforce counteracting the tipping is provided. It is conceivable for the strip portion to be reinforced in the region in which the abutment portion interacts when the container is pulled out.

The abutment portion is preferably provided as an extension of the strip portion or is formed integrally therewith. The top of the abutment portion can advantageously lift above the strip portion such that there is a defined abutment surface between the abutment portion and the bottom of the guide strip.

According to a further embodiment of the invention, the dead stop on the guide element is arranged at a distance from the guide rail in the pull-out direction. In this way, dirt that can accumulate on the guide rail can be discharged through a gap between the dead stop and the guide rail.

The dead stop can in turn have a sliding surface on the top, along which the bottom of the strip portion slides when the container is moved in the pull-out direction. The weight of the container is therefore advantageously conveyed first via the rear stops and then via the dead stop into the relevant guide element during the movement.

In order to ensure that the container remains securely in the retracted, rear position, it is conceivable for the bottom of the container to have a receptacle which is complementary to the top of the dead stop and in which the dead stop engages in the defined rear position. In order to move the container out of the retracted position, the container can be lifted at the front side, as already described, such that the front stop of the container is raised above the dead stop.

It is conceivable for the receptacle in which the dead stop remains in the rear, retracted position to be delimited by the front stop of the container.

The above-mentioned problem is also solved by a container of a shelf system according to the invention. The container can have all the features that were described above and relate to the container. A container of this kind is characterized in particular in that it has, in the side walls, the recesses for engaging the guide strip, and in that the front stop and the rear stop are arranged below the relevant recess. Furthermore, the rear stops can also have a sliding surface on the bottom which slides on a guide rail of the guide element when the container is moved. Further advantageous embodiments of the container also result in particular from the claims relating to the container.

Further details and advantageous embodiments of the invention can be found in the following description, on the basis of which one embodiment of the invention shall be described and explained in more detail.

DETAILED DESCRIPTION

Figure 1:
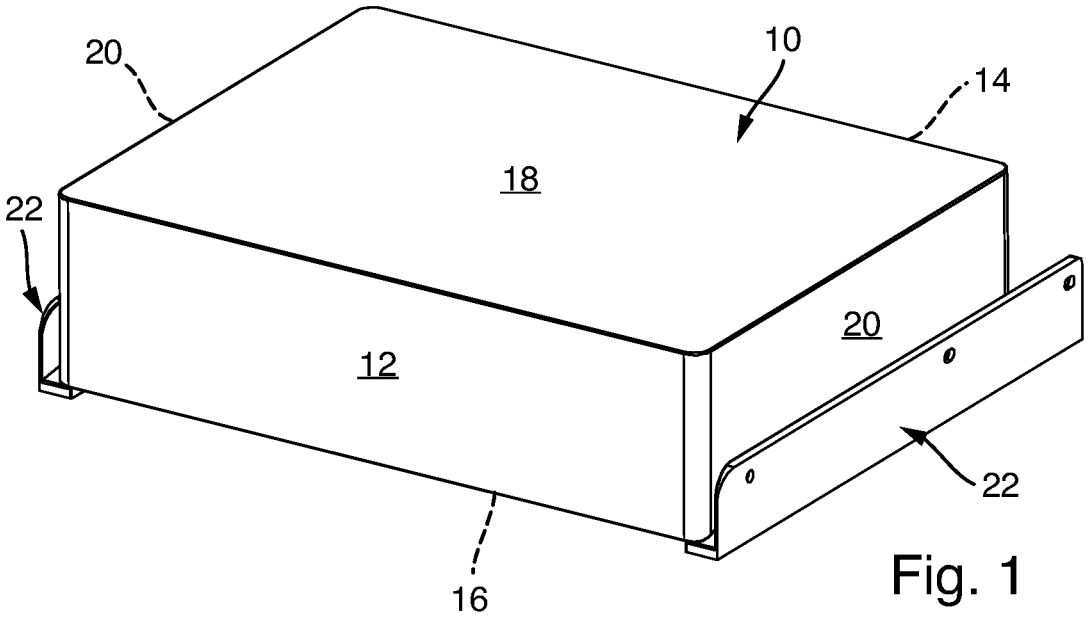
FIG. 1 is a perspective view of a shelf system according to the invention with a container and guide elements.
Figure 2:
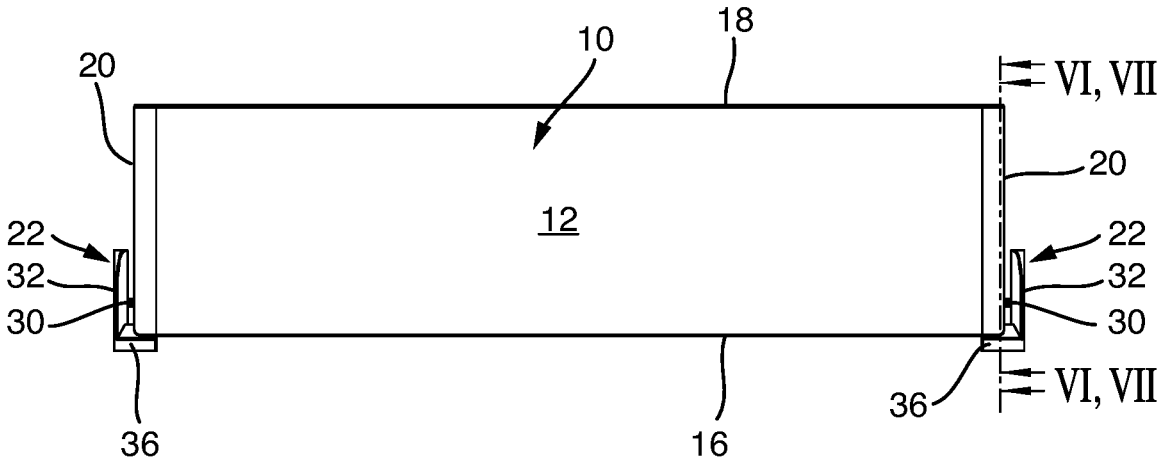
FIG. 2 is a front view of the shelf system according to FIG. 1.

The shelf system shown in the drawings comprises a schematically indicated container 10, which can be designed as a case, box or the like. The container 10 can in particular be provided for the transport of tools or machines.

The container 10 has a front side 12, a rear side 14, a bottom 16, a top 18 and two opposing side walls 20. The shelf system further comprises two guide elements 22 arranged to the side of the container 10. As will be explained further below, the container 10 can be moved along the guide elements 22 from a rear, retracted position, as shown in FIG. 6, into a front, extended position, as shown in FIG. 7.

Figure 6:
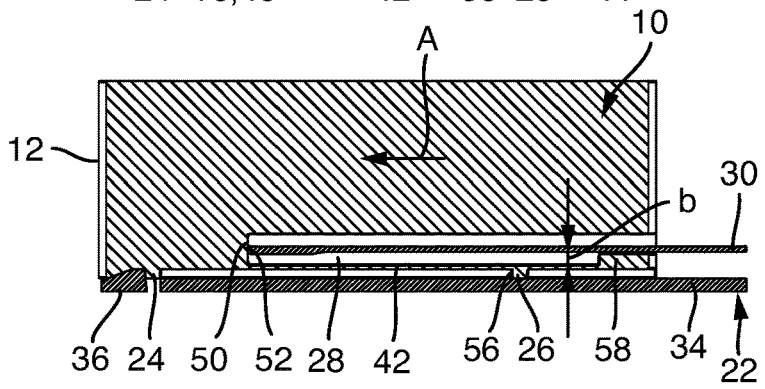
FIG. 6 shows a section along line VI in FIG. 2, in which the container remains in the retracted, rear position.
Figure 7:
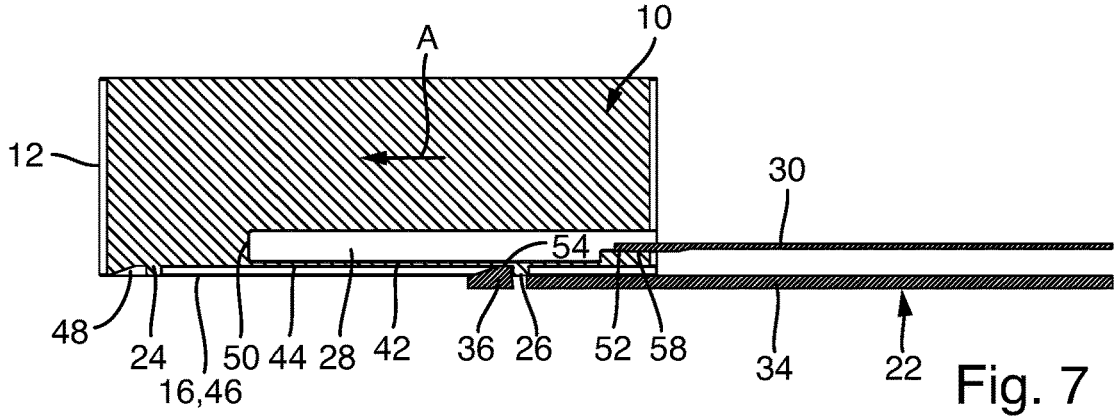
FIG. 7 shows a section along line VII in FIG. 2, in which the container remains in the front, extended position.

In order to ensure that the container 10 remains in the rear position shown in FIG. 6, two front stops 24 are provided on the bottom 16 of the container 10 in the region of the side walls 20. In order to ensure that the container 10 remains in the front, extended position shown in FIG. 7, two rear stops 26 are provided on the bottom of the container 10, also in the region of the side walls 20.

Figure 4:
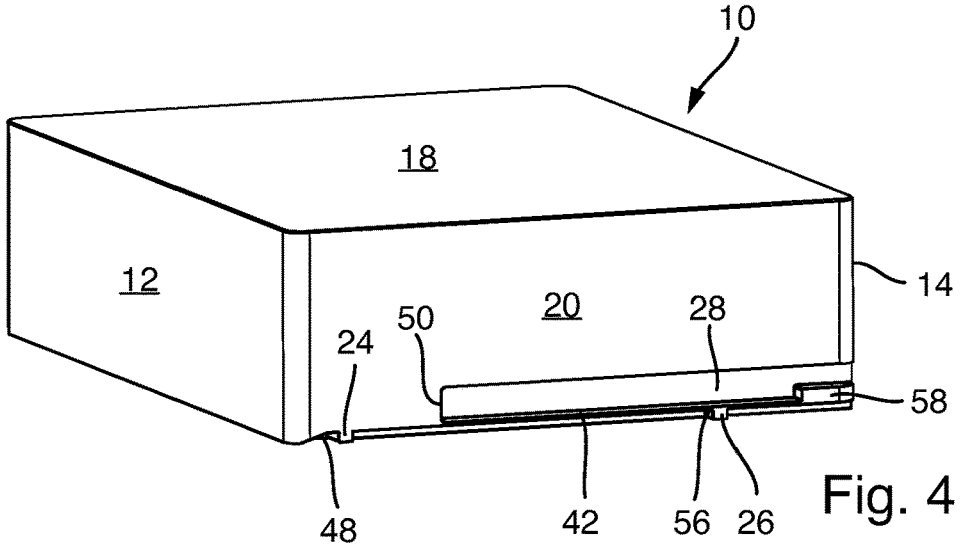
FIG. 4 is a perspective view of a container of the shelf system according to FIGS. 1 and 2.
Figure 5:
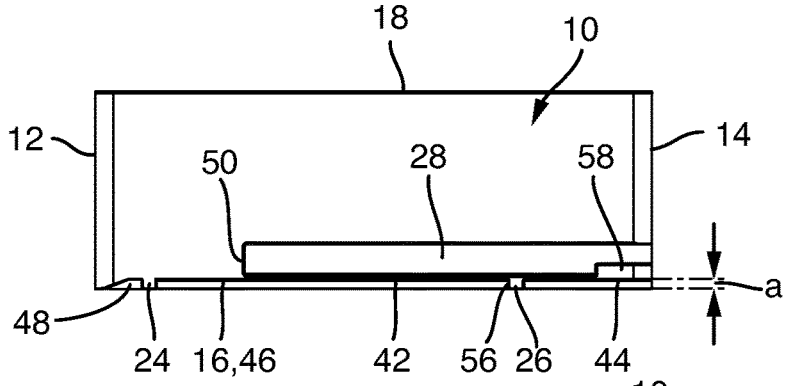
FIG. 5 shows the side view of the container according to FIG. 4.

As is clear in particular from FIGS. 4 and 5, a recess 28 which is open toward the rear side 14 is provided in each of the side walls 20 of the container 10. As is clear in particular from FIGS. 6 and 7, guide strips 30 provided on the guide elements 22 engage in the recesses 28.

As is also clear from FIG. 4 to 7, the stops 24, 26 are not located within the recess 28, but are arranged therebelow, extending downward outside the recess 28.

As is clear in particular from FIG. 3, the guide element 22 has a cheek 32 on which the guide strip 30 and a guide rail which extends in parallel with the guide strip 30 and is arranged below the guide strip 30 by the dimension d are provided. The guide strip 30 is arranged so as to be offset to the rear by the dimension c with respect to the guide rail 34. A dead stop 36 is also provided on the cheek 32, which dead stop interacts with the front stops 24 in the retracted, rear position and interacts with the rear stops 26 in the front, extended position.

Figure 3:
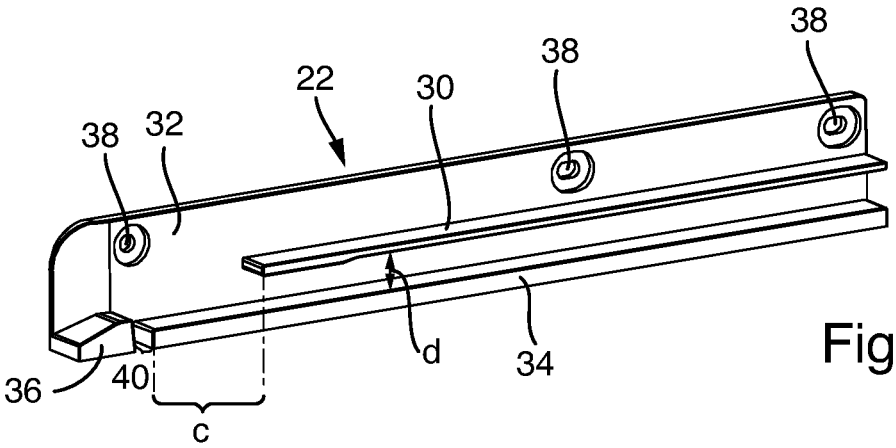
FIG. 3 shows a detail of a guide element of the shelf system according to FIGS. 1 and 2.

As is also clear from FIG. 3, the cheek 32 also has fastening holes 38 by means of which the guide element 22 can be fastened to a frame, for example. In the assembled state, the cheek is arranged in the vertical direction, with the relevant guide strip 30 and the relevant guide rail 34 then extending in the vertical direction. It is also clear from FIG. 3 that the dead stop 36 is arranged so as to be spaced apart from the guide rail 34 by the gap 40. As a result, dirt which can accumulate on the guide rail 34 can be discharged downward through the gap 40 between the dead stop 36 and the guide rail 34.

As is clear from FIG. 4 to 7, the recesses 28 are delimited at the bottom by a strip portion 42. The strip portion 42 extends in the pull-out direction of the container 10. The relevant rear stop 26 is arranged so as to project downward on the strip portion 42. In addition, the bottom 44 of the strip portion is not in a base plane 46 formed by the bottom 16 of the container 10, but is set back upward by the dimension a.

It is clear from FIGS. 4 and 5 that the container 10 has receptacles 48 that are complementary to the top of the dead stop 36. In the defined rear position shown in FIG. 6, the top of the dead stop 36, which is wedge-shaped in cross section, engages in the receptacle 48 such that the container 10 remains in this rear position. The receptacle 48 is delimited at the rear by the front stop 24.

In order to prevent the container 10 from moving too far back, the receptacle 28 has a stop surface 50 which extends transversely to the insertion direction. In the inserted position shown in FIG. 6, the front free end 52 of the guide strip 30 comes to abut the stop surface 50.

In order to move the container 10 from its rear defined position shown in FIG. 6 into the front position shown in FIG. 7, the front side 12 of the container 10 must first be lifted to such an extent that the front stops 24 are raised above the relevant dead stop 26. In order to make this possible, the guide strips 30 are spaced apart from the top of the strip portion 34 to such an extent and are also offset to the rear to such an extent that lifting of this kind is possible.

After the front stops 24 have been lifted above the dead stops 36, the container 10 can be moved in the pull-out direction A. In this case, sliding surfaces 56 provided on the bottoms of the rear stops 26 slide on the guide rails 34 of the guide elements 22. At the same time, the bottoms 44 of the strip portions 42 slide on the top of the dead stops, which are also designed as a sliding surface 54.

In order to prevent the front side 12 of the container 10 from tipping when the container 10 is pulled out, an abutment portion 58 is provided on each of the side walls 20 and is supported on the bottom of the relevant guide strip 30. The relevant abutment portion 58 is provided as an extension of the relevant strip portion 42 at the rear end of the relevant side wall 20. The top of the relevant abutment portion 58 rises, as shown in FIG. 5, by the dimension b above the top of the associated strip portion 42.

As shown in FIG. 7, the rear stops 26 abut the dead stops 36 in the defined front position. In addition, the abutment portions 58 abut the guide strips 30 in the region of the ends 52 of said strips. In order to remove the container 10 from the guide elements 22 or to remove it from the shelf system, the front side 12 of the container 10 can be lifted again, proceeding from the front defined position shown in FIG. 7, to such an extent that the rear stops 26 can be raised above the dead stops 36. If the front side 12 of the container 10 is then lowered again, the rear stops 26 slide forward and downward on the wedge-shaped tops of the dead stops 36. At the same time, the abutment portions 58 move out of their effective range with the free ends 52 of the guide strips 42, such that the container 10 can finally be removed manually in a simple manner.

If the container 10 is then to be reinserted into the shelf system, the rear sides 14 with the recesses 28 which are open to the rear are to be placed on the guide elements 22 such that the free ends 52 of the guide strips 30 dip into the recesses 28. By pushing the container 10 backward accordingly, initially the rear stops 26 slide over the wedge-shaped top of the dead stops 26 and, when the container 10 is moved further counter to the pull-out direction A, the front stops 24 ultimately also slide until the dead stops 36 come to rest in the receptacles 48.

The invention claimed is:

1. Shelf system for service vehicles, comprising at least one container which has a front side, a rear side, a bottom, a top and two side walls, and comprising at least one guide element along which the container can be moved in the pull-out direction (A) from a rear, retracted position into a front, extended position, with at least one rear stop and at least one front stop being provided on the container and interacting with a dead stop provided on at least one guide element in such a way that the container remains in a defined rear position and, when moved in the pull-out direction (A), in a defined front position, and a recess being provided in at least one side wall of the container for engaging a guide strip provided on the guide element, wherein the recess is delimited at the bottom by a strip portion characterized in that at the strip portion the rear stop is arranged projecting downwards such that the at least one front stop and the at least one rear stop are arranged below the recess.

2. Shelf system according to claim 1, characterized in that the at least one rear stop has a sliding surface on its bottom which slides on a guide rail of the guide element when the container is moved.

3. Shelf system according to claim 2, characterized in that the guide rail is arranged below the guide strip on at least one guide element.

4. Shelf system according to claim 2, characterized in that at least one guide element has a cheek on which the guide rail and the guide strip are arranged.

5. Shelf system according to claim 2, characterized in that the guide strip is arranged so as to be offset to the rear with respect to the guide rail.

6. Shelf system according to claim 1, characterized in that the bottom of the relevant strip portion is arranged so as to be set back upward from a base plane lying in the bottom of the container.

7. Shelf system according to claim 6, characterized in that the sliding surface of one of the rear stop lies in the base plane.

8. Shelf system according to claim 1, characterized in that the guide strip is spaced apart and/or set back to the rear from the top of the strip portion to such an extent that the front side of the container in the defined rear position can be lifted to such an extent that the front stop can be raised above the dead stop.

9. Shelf system according to claim 1, characterized in that the guide strip is spaced apart and/or set back to the rear from the top of the strip portion to such an extent that the front side of the container in the defined front position can be lifted to such an extent that the rear stop can be raised above the dead stop.

10. Shelf system according to claim 1, characterized in that an abutment portion is provided on at least one side wall, in the region facing the rear side, for abutting, in a supporting manner, the bottom of the guide strip of the guide element.

11. Shelf system according to claim 10, characterized in that the abutment portion is provided as an extension of the strip portion and rises above the top of the strip portion.

12. Shelf system according to claim 2, characterized in that the dead stop on the at least one guide element is arranged at a distance from the guide rail in the pull-out direction.

13. Shelf system according to claim 1, characterized in that the dead stop has a sliding surface on its top, along which the bottom of the strip portion slides when the container is moved in the pull-out direction (A).

14. Shelf system according to claim 1, characterized in that the container has a receptacle which is complementary to the top of the dead stop and in which the dead stop engages in the defined rear position.

15. Shelf system according to claim 14, characterized in that the receptacle is delimited at the rear by the front stop.

16. Container of a shelf system comprising at least one guide element along which the container can be moved in the pull-out direction (A) from a rear, retracted position into a front, extended position, with at least one rear stop and at least one front stop being provided on the container and interacting with a dead stop provided on at least one guide element in such a way that the container remains in a defined rear position and, when moved in the pull-out direction (A), in a defined front position, and a recess being provided in at least one side wall of the container for engaging a guide strip provided on the guide element, wherein the recess is delimited at the bottom by a strip portion characterized in that at the strip portion the rear stop is arranged projecting downwards such that the at least one front stop and the at least one rear stop are arranged below the recess, the container comprising a front side, a rear side, a bottom, a top and two side walls, with at least one rear stop and at least one front stop being provided on the container and interacting with at least one dead stop provided on a guide element of the shelf system in such a way that the container remains in a defined rear position and, when moved in the pull-out direction (A), in a defined front position, and a recess being provided in at least one side wall of the container for engaging a guide strip provided on the guide element, characterized in that the at least one front stop and the at least one rear stop are arranged below the recess.

17. Container according to claim 16, characterized in that the at least one rear stop has a sliding surface on its bottom which slides on a guide rail of the guide element when the container is moved.

18. Container according to claim 16, characterized in that the recess is delimited at the bottom by a strip portion.

19. Container according to claim 18, characterized in that the bottom of the strip portion is arranged so as to be set back upward from a base plane lying in the bottom of the container and/or in that the sliding surface of one of the rear stop lies in the base plane.

20. Container according to claim 16, characterized in that an abutment portion is provided on at least one side wall, in the region facing the rear side, for abutting, in a supporting manner, the bottom of the guide strip of the guide element.

21. Container according to claim 20, characterized in that the abutment portion is provided as an extension of the strip portion and rises above the top of the strip portion.

* * * * *